US006796140B1

(12) United States Patent
Weng et al.

(10) Patent No.: US 6,796,140 B1
(45) Date of Patent: Sep. 28, 2004

(54) HEAT EXCHANGER

(75) Inventors: Kuo-Liang Weng, Taichung Hsien (TW); Ming-Tsun Ke, Taipei (TW); Jing-Wen Weng, Taichung Hsien (TW)

(73) Assignee: Cohand Technology Co., Ltd., Taichung Hsien (TW)

( * ) Notice: Subject to any disclaimer, the term of this patent is extended or adjusted under 35 U.S.C. 154(b) by 0 days.

(21) Appl. No.: 10/731,506

(22) Filed: Dec. 10, 2003

(51) Int. Cl.[7] ..... F28D 5/00

(52) U.S. Cl. ..... 62/311; 62/305; 62/309; 165/60

(58) Field of Search ..... 62/305, 309, 310, 62/311, 315; 165/60

(56) References Cited

U.S. PATENT DOCUMENTS 6,282,913 B1 * 9/2001 Moriguchi et al. ..... 62/259.2

6,434,963 B1 * 8/2002 Urch ..... 62/279

FOREIGN PATENT DOCUMENTS

JP 405010656 A * 1/1993 ..... 62/291

* cited by examiner

*Primary Examiner*—Melvin Jones
(74) *Attorney, Agent, or Firm*—Troxell Law Office PLLC

(57) ABSTRACT

A heat exchanger with improved heat exchange capability mainly includes a primary heat exchanger, a water vaporization device and a secondary heat exchanger. The secondary heat exchanger may be coupled with the water vaporization device to generate liquid and vapor phase transformation to increase heat exchange capability of the heat exchanger and save energy and reduce thermal pollution.

12 Claims, 4 Drawing Sheets

HEAT EXCHANGER

BACKGROUND OF THE INVENTION

1. Field of the Invention

The present invention relates to a heat exchanger with improved heat exchange capability to save energy and reduce thermal pollution.

2. Description of the Prior Art

A conventional refrigeration air conditioning system 9 (as shown in FIG. 1) mainly includes a compressor 91, a condenser 92, an evaporator 93, a refrigerant flow controller 94 and a refrigerant switch valve 95. The condenser 92 and the evaporator 93 generally are called heat exchanger (or heat exchange device) A. It mainly includes, a coiled tube L and an air fan motor M (referring to FIG. 2). Such a heat exchanger has drawbacks in operation, notably:

1. During heat discharge operation, heat exchange occurs between air intake and the coiled tube of the heat exchanger. Heated air is directly discharged into atmosphere. The heated air produces thermal pollution to the environment.
2. In lower temperature, seasons (such as winter) water content in the air is low during heat absorption operation. Only sensible heat is exchanged during heat exchange process. As a result, heat exchange capability and efficiency decrease significantly.

SUMMARY OF THE INVENTION

In view of the aforesaid disadvantages, the present invention aims to provide an improved heat exchanger that mainly includes a primary heat exchanger, a water vaporization device and a secondary heat exchanger. The secondary heat exchanger can raise the temperature of air intake to increase water absorption capability of the air and improve moisture boosting capability of the water vaporization device so that water content in the air increases and heat exchange capability of the primary heat exchanger is enhanced thereby energy may be saved and thermal pollution is reduced.

The objects of the invention are as follow:

1. Provide a heat exchanger with improved heat exchange capability. When the primary heat exchanger is functioned to discharge heat and coupled with the water vaporization device for moisture boosting, water content in the air may increase to enhance heat exchange capability of the primary heat exchanger and transform sensible heat to latent heat thereby to save energy and reduce thermal pollution.
2. Provide a heat exchanger with improved heat exchange capability. When the heat exchanger is functioned to absorb heat, it employs the secondary heat exchanger to preheat air intake. Coupled with the water vaporization device to add moisture, water content in the air may increase thereby enhance heat exchange capability of the primary heat exchanger and save energy.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
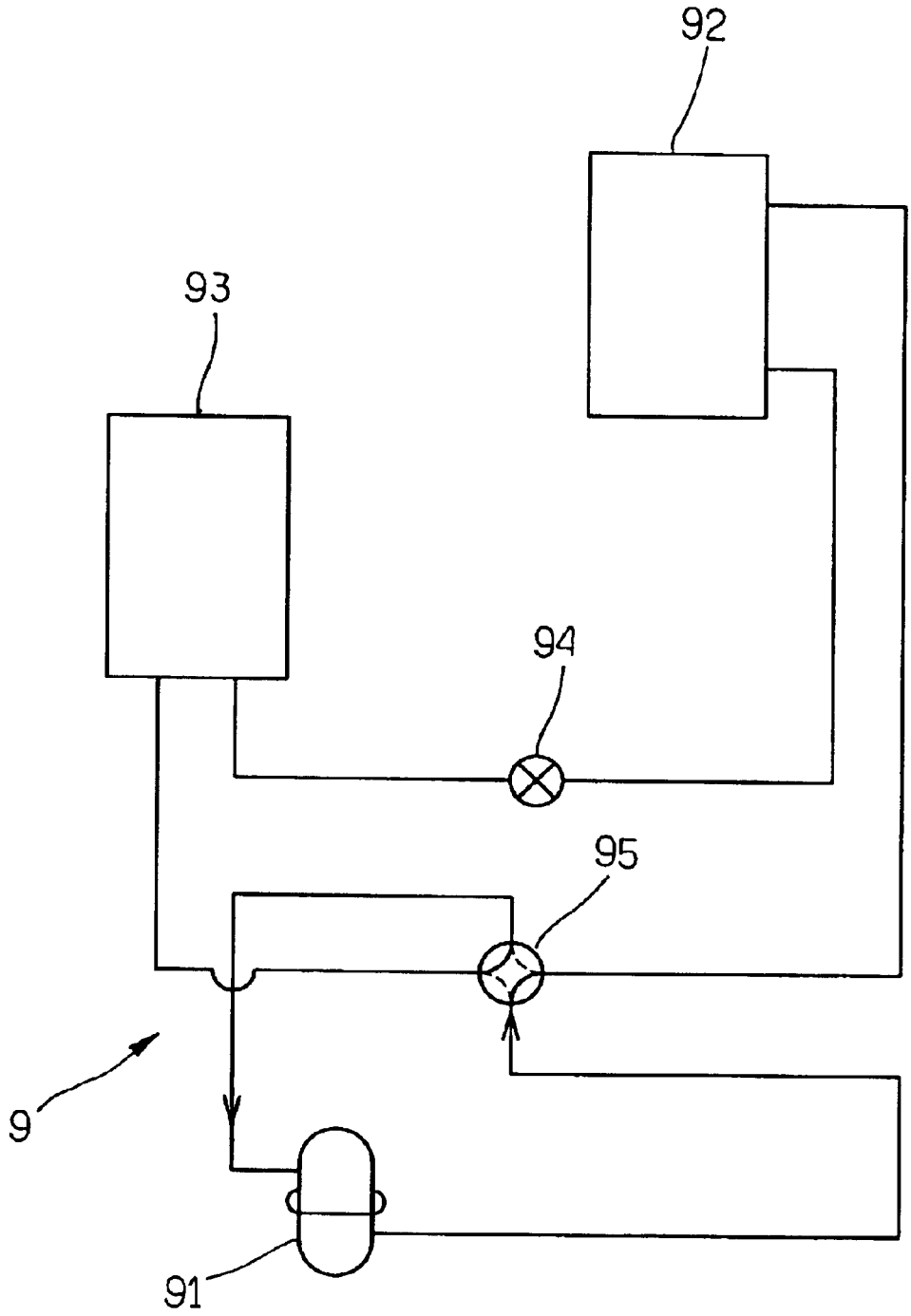
FIG. 1 PRIOR ART
FIG. 1 is a schematic view of a conventional refrigeration air conditioning system.
Figure 2:
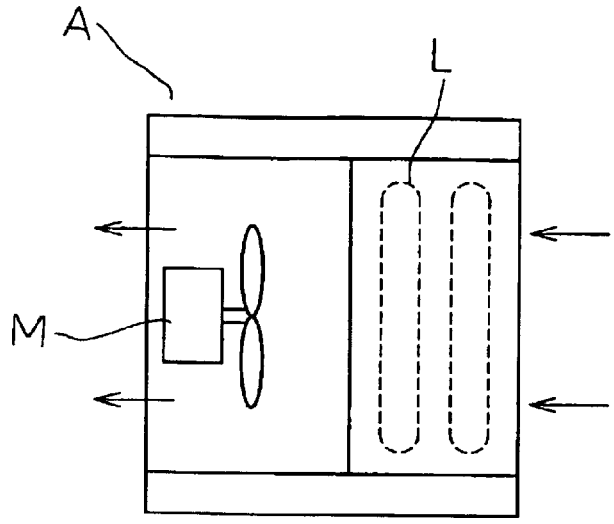
FIG. 2 PRIOR ART
FIG. 2 is a sectional view of a conventional heat exchanger.
Figure 3:
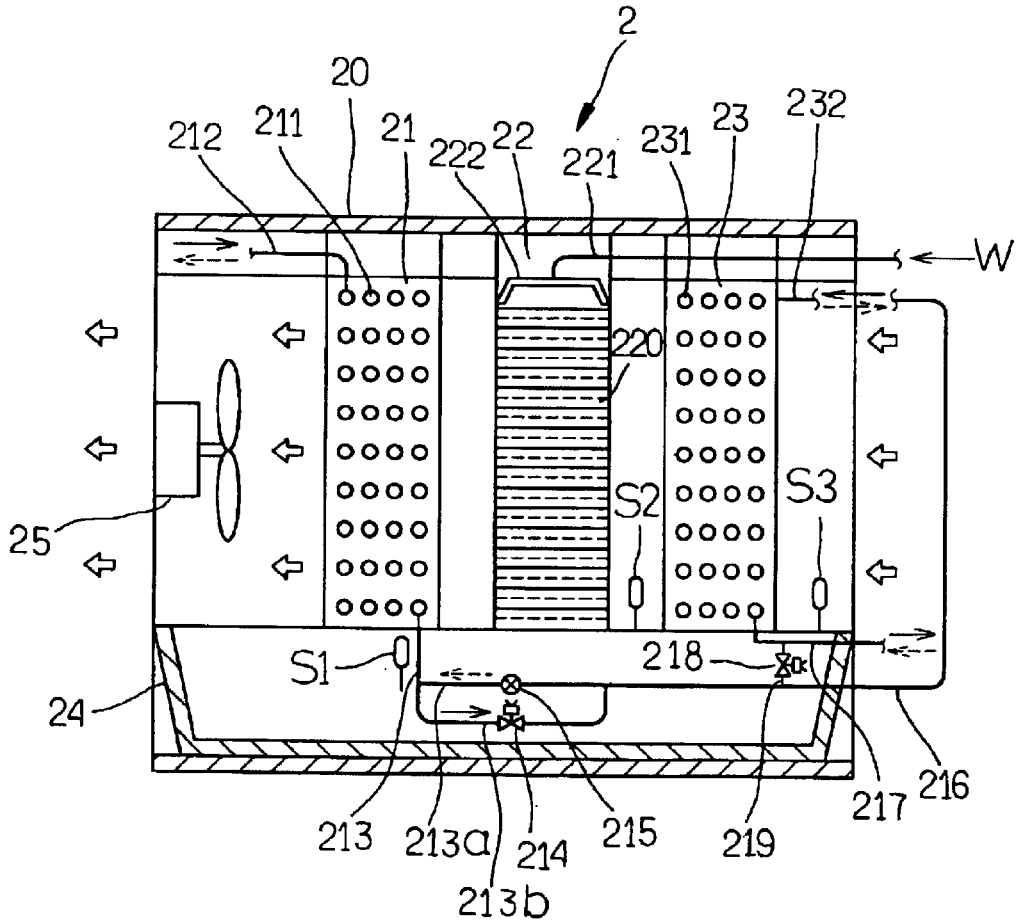
FIG. 3 is a sectional view of the invention.
Figure 4:
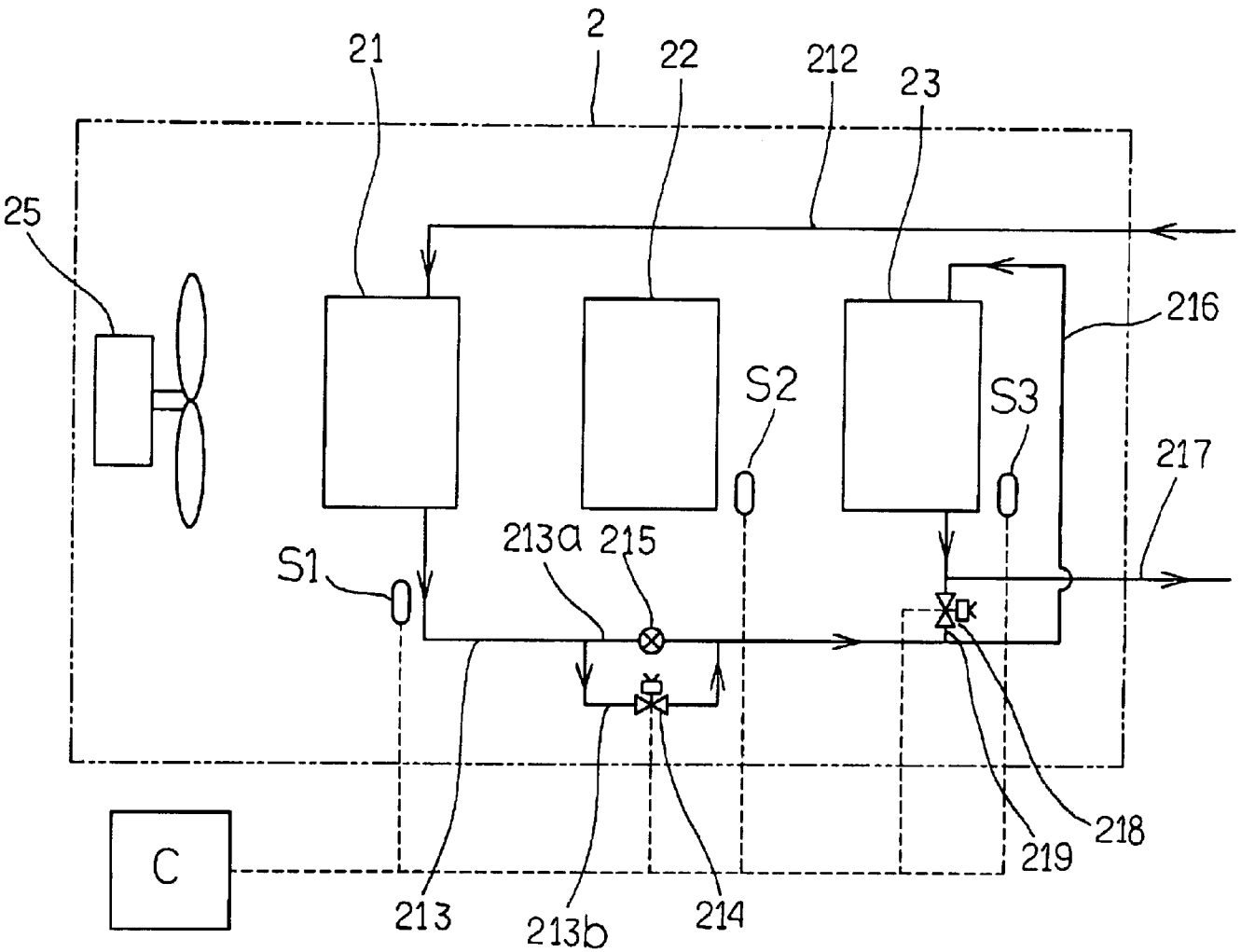
FIG. 4 is a schematic view of the system according to the invention.

Referring to FIGS. 3 and 4, the present invention mainly includes a heat exchanger 2 which has a case 20. In the case 20, there are a primary heat exchanger 21, a water vaporization device 22 and a secondary heat exchanger 23. There is further a water collection tray 24 located at the bottom of the case 20.

The primary heat exchanger 21 includes an air fan 25 with a heat exchange coiled tube 211 located therein. It has an upper end connecting to a first refrigerant delivery tube 212 to circulate refrigerant and a lower end connecting to a second refrigerant delivery tube 213, a third refrigerant delivery tube 216 and a secondary heat exchanger 23. The second refrigerant delivery tube 213 has one end splitting into two branch tubes 213*a* and 213*b*. The first branch tube 213*a* is coupled with a refrigerant flow controller 215. The second branch tube 213*b* is coupled with a first refrigerant solenoid check valve 214. The two branch tubes 213*a* and 213*b* have another end converged to connect to the third refrigerant delivery tube 216.

The water vaporization device 22 generates water vapor from water and air intake. It has a water discharge head 222 on an upper side to connect to a water intake tube 221. Water intake w is ejected through the water discharge head 222 to form moisture; or the water discharge head 222 is connected to a body 220 made from air and water permeable material to generate heat exchange and increase moisture between the passing air and water molecules.

The secondary heat exchanger 23 is located at a front side of the air intake side of the water vaporization: device 22. It includes a heat exchange coiled tube 231 which has an upper end connecting to the third refrigerant delivery tube 216 and a lower end connecting to a fourth refrigerant delivery tube 217. System circulating refrigerant may enter the heat exchange coiled tube 231 and flow out. The fourth refrigerant delivery tube 217 and the third refrigerant delivery tube 216 are bridged by a fifth refrigerant delivery tube 219 which is coupled with a second refrigerant solenoid check valve 218.

A temperature sensor is provided which includes a first sensor S1, a second sensor S2 and a third sensor S3 that are connected to a controller C. The first sensor S1 is to detect the temperature T1 of the refrigerant discharged from primary heat exchanger 21. The second sensor S2 is to detect the temperature T2 of the air discharged from the secondary heat exchanger 23. The third second sensor S3 is to detect the temperature TO of the air intake.

By means of the elements and construction set forth above, when the primary heat exchanger 21 operates mainly for discharging heat, the refrigerant flows from the first refrigerant delivery tube 212 into the heat exchange coiled tube 211 of the primary heat exchanger 21 (shown by the arrows in FIG. 3 and also shown in FIG. 4), and flows out through a lower end of the second refrigerant delivery tube 213, then branches through the second branch tube 213*b* (with the first refrigerant solenoid check valve 214 controlled by the controller C and open), and the third refrigerant delivery tube 216, and flows into the heat exchange coiled tube 231 of the secondary heat exchanger 23, and through the fourth refrigerant delivery tube 217 to enter the system. The heat exchange coiled tube 231 of the secondary heat exchanger 23 is a passage which the circulation refrigerant flows through. In addition, when the temperature T1 of the refrigerant discharged from the primary heat exchanger 21 is lower than the air intake temperature T0 (i.e. T1<T0), it means that the system has a small heat discharge requirement. The controller C controls and opens the second refrigerant solenoid check valve 218 (ON), and the refrigerant directly flows to the system from the fourth refrigerant delivery tube 217 through the branch tube. When the temperature T1 of the refrigerant discharged from the primary heat exchanger 21 is higher than the air intake temperature T0 (i.e. T1>T0), it means that the system has a greater heat discharge requirement. The controller C controls and closes the second refrigerant solenoid check valve 218 (OFF), and the refrigerant flows from the third refrigerant delivery tube 216 to the secondary heat exchanger 23 to discharge heat again to increase air temperature due to sensible heat effect so that air intake passes through the vaporization device 22 to increase moisture and water content in the air. As a result, heat exchange capability of the primary heat exchanger 21 improves, and energy may be saved and thermal pollution to the environment may be reduced.

Figure 5:
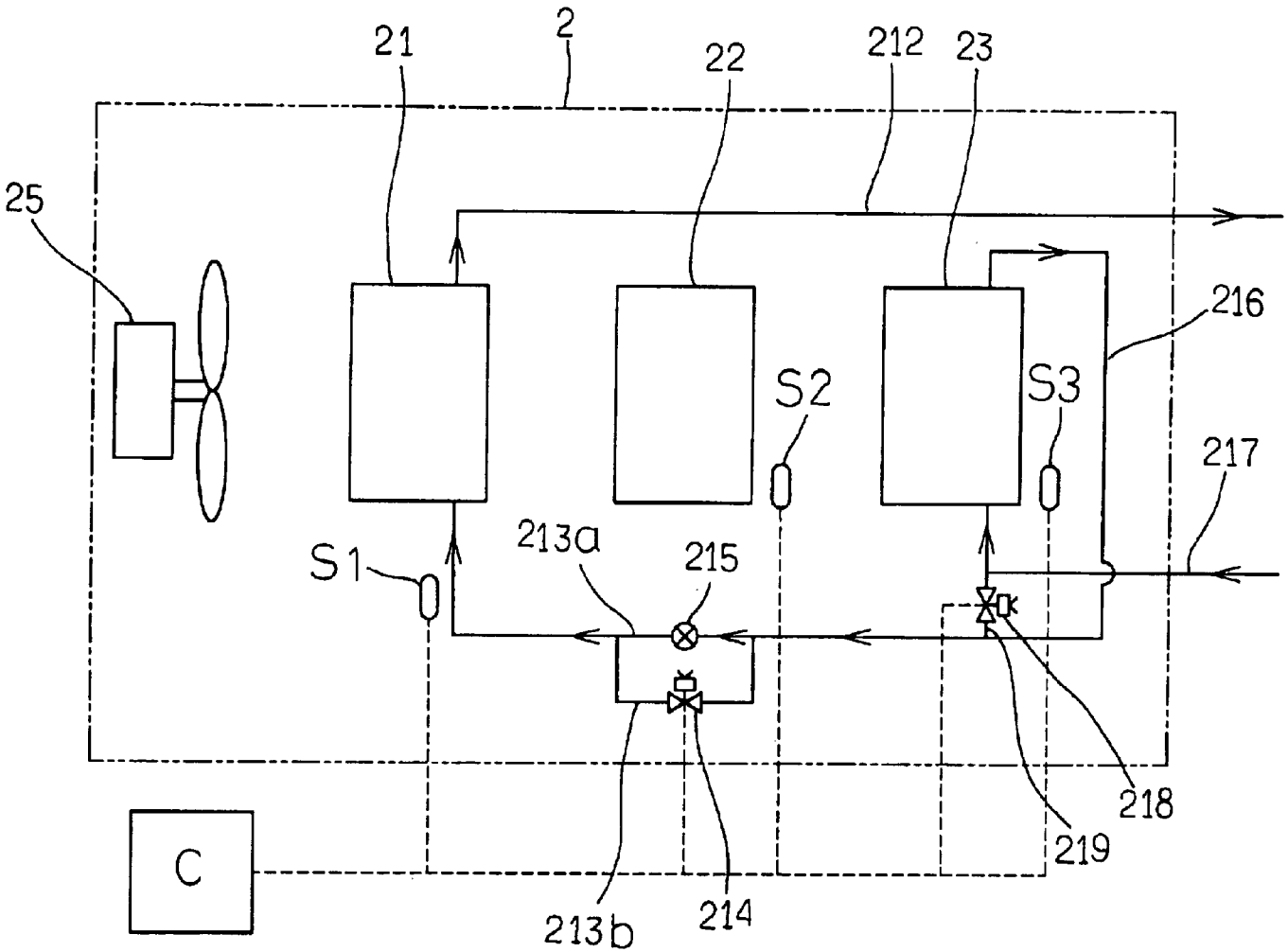
FIG. 5 is another schematic view of the system according to the invention.

When the primary heat exchanger 21 operates mainly for absorbing heat (referring to FIGS. 3 and 5), the refrigerant flows from the fourth refrigerant delivery tube 217 into the heat exchange coiled tube 231 of the secondary heat exchanger 23 (flowing direction is indicated by broken lines in FIG. 3), and flows through the third refrigerant delivery tube 216, first branch tube 213*a*, and second refrigerant solenoid check valve 215 (with the first refrigerant solenoid check valve 214 on the second branch tube 213*b* and the second refrigerant solenoid check valve 218 closed). The refrigerant further flows from the second refrigerant delivery tube 213 into the heat exchange coiled tube 211 of the primary heat exchanger 21, then flows from the first refrigerant delivery tube 212 into the system. Due to the air intake is at a low temperature and low humidity, the temperature of the refrigerant in the heat exchange coiled tube 231 of the secondary heat exchanger 23 is higher than the air intake temperature. Under the heat exchange effect, the air intake will be preheated to a higher temperature. After passing through the water vaporization device 22, water and air intake will have a higher humidity due to water vaporization effect. Thus water content in the air intake may increase to improve the heat exchange capability of the primary heat exchanger 21, and energy may be saved.

In summary, the invention employs a secondary heat exchanger to couple with transformation of liquid and vapor phases occurred in a water vaporization device to improve heat exchange capability thereby to enhance operation efficiency of the heat exchanger, and save energy and reduce thermal pollution to the environment.

What is claimed is:

1. A heat exchanger having improved heat exchange capability, comprising:

a primary heat exchanger including an air fan which has a heat exchange coiled tube located therein for circulating system refrigerant;

a water vaporization device for generating water vapor from water and air intake to allow passing air and water molecules to generate heat exchange function and add moisture; and a secondary heat exchanger located at a front side of an air intake side of the water vaporization device having a heat exchange coiled tube which has an upper end connecting to the primary heat exchanger through a refrigerant delivery tube and a lower end connecting to a fourth refrigerant delivery tube.

2. The heat exchanger of claim 1, wherein the water vaporization device has a water discharge head connecting to a body which is made from an air and water permeable material.

3. The heat exchanger of claim 1, wherein the primary heat exchanger has an upper end connecting to a first refrigerant delivery tube.

4. The heat exchanger of claim 1 further including a first sensor, a second sensor and a third sensor that are connected to a controller.

5. The heat exchanger of claim 4, wherein the first sensor detects the temperature of the refrigerant discharged from the primary heat exchanger.

6. The heat exchanger of claim 4, wherein the second sensor detects the air temperature discharged from the secondary heat exchanger.

7. The heat exchanger of claim 4, wherein the third sensor detects the temperature of the air intake.

8. The heat exchanger of claim 1, wherein the primary heat exchanger has a lower end connecting to a second refrigerant delivery tube.

9. The heat exchanger of claim 8, wherein the second refrigerant delivery tube has two branch tubes, one of the branch tubes being coupled with a refrigerant flow controller and another branch tube being coupled with a first refrigerant solenoid check valve.

10. The heat exchanger of claim 9, wherein the two branch tubes have another ends converged to connect to a third refrigerant delivery tube.

11. The heat exchanger of claim 1, wherein the fourth refrigerant delivery tube and the third refrigerant delivery tube are bridged by a fifth refrigerant delivery tube which is coupled with a second refrigerant solenoid check valve.

12. The heat exchanger of claim 1, wherein the water vaporization device has a water discharge head on an upper side connecting to a water intake tube.

* * * * *